US007516869B1

(12) United States Patent
Hajianpour

(10) Patent No.: US 7,516,869 B1
(45) Date of Patent: Apr. 14, 2009

(54) BEVERAGE CONTAINER WITH AN OPENING TAB AND A SELF-DEPLOYING STRAW

(75) Inventor: Mohammed Ali Hajianpour, Fort Lauderdale, FL (US)

(73) Assignee: Zoya, Inc,, Ft. Lauderdale, FL (US)

( * ) Notice: Subject to any disclaimer, the term of this patent is extended or adjusted under 35 U.S.C. 154(b) by 132 days.

(21) Appl. No.: 11/316,485

(22) Filed: Dec. 21, 2005

(51) Int. Cl.
*A47G 19/22* (2006.01)

(52) U.S. Cl. ..... 220/707; 220/705; 220/706; 220/708; 220/710; 215/388; 215/389

(58) Field of Classification Search ..... 220/705–708, 220/710; 215/388, 389
See application file for complete search history.

(56) References Cited

U.S. PATENT DOCUMENTS 3,349,955 A * 10/1967 Cornelius ..... 220/707
3,409,224 A * 11/1968 Harp et al. ..... 239/33
3,656,654 A 4/1972 Brinkley, III
3,946,895 A 3/1976 Pugh
3,980,210 A * 9/1976 Kligerman ..... 222/456
4,226,356 A * 10/1980 Lemelson ..... 220/270
4,228,913 A * 10/1980 Mack et al. ..... 220/710
4,356,927 A * 11/1982 Cooper et al. ..... 220/710
4,537,324 A * 8/1985 Wang ..... 220/706
4,690,294 A * 9/1987 Jones ..... 220/707
4,709,829 A * 12/1987 Johnson et al. ..... 220/706
4,712,702 A * 12/1987 Ayabe et al. ..... 220/706
4,826,034 A * 5/1989 Forbes ..... 220/705
4,923,083 A * 5/1990 Forbes ..... 220/705
4,923,084 A * 5/1990 Forbes ..... 220/705
4,930,652 A * 6/1990 Murphy et al. ..... 220/706
5,054,639 A * 10/1991 Ahn ..... 220/706
5,071,019 A * 12/1991 Sizemore ..... 220/709
5,160,058 A * 11/1992 Ahn ..... 215/388
5,172,827 A * 12/1992 Chang et al. ..... 220/707
5,244,112 A * 9/1993 Murphy et al. ..... 220/706
5,253,779 A * 10/1993 Lee ..... 220/705
5,431,297 A * 7/1995 Rosello ..... 220/706
5,547,103 A * 8/1996 Murphy et al. ..... 220/709
5,586,681 A * 12/1996 Policappelli ..... 220/674
5,728,415 A * 3/1998 Troska ..... 426/112
5,788,106 A * 8/1998 Hotinski ..... 220/269
5,819,979 A * 10/1998 Murphy et al. ..... 220/706
5,848,721 A * 12/1998 Cornell et al. ..... 220/706
6,131,763 A * 10/2000 Stanish et al. ..... 220/706
6,296,140 B1 * 10/2001 Prieto ..... 220/707
6,354,460 B1 * 3/2002 Cornell et al. ..... 220/706
6,375,032 B1 * 4/2002 Kim ..... 220/707
6,443,324 B1 * 9/2002 Buntain ..... 220/705
6,491,184 B2 * 12/2002 Prieto ..... 220/709
2002/0125261 A1 * 9/2002 Kim ..... 220/706

* cited by examiner

*Primary Examiner*—Anthony D Stashick
*Assistant Examiner*—Christopher B McKinley
(74) *Attorney, Agent, or Firm*—Ronald V. Davidge

(57) ABSTRACT

A straw is held within a beverage container in a manner providing for the upper end of the straw to be deployed upward, through an opening provided within the top of the container when an opening tab in the top of the container is pivoted downward. An upper end of the straw is held in a straw holding portion of a straw supporting structure within the beverage container, with the straw supporting structure including a cantilever portion that is deflected downward by contact with an edge of the opening tab as the opening tab is pivoted downward.

19 Claims, 4 Drawing Sheets

BEVERAGE CONTAINER WITH AN OPENING TAB AND A SELF-DEPLOYING STRAW

BACKGROUND OF THE INVENTION

1. Field of the Invention

This invention relates to a beverage can and, more particularly, to a beverage can having a top including an opening tab and a straw stored in the can being deployed when the tab is opened.

2. Summary of the Background Art

The patent literature includes a number of descriptions of beverage cans including opening tabs and straws held within the can and within its contents to be deployed for drinking the contents when the tab is opened. Such a can would provide the advantages of allowing the user to drink a beverage from a can through a straw supplied within the can, without having to upend the can and without having to touch his mount or lips to the exterior surfaces of the can.

Early descriptions of such cans included tear-off strips or tabs that were pulled upward from the top of the can to expose an opening therein. For example, U.S. Pat. No. 3,656,654 describes a can having a tab, in the form of a tear-out strip sealing a hole in its top, with a positioning member attached to the tear-out strip holding the upper end of a straw held within the can, so that this upper end of the straw is pulled outward through the hole remaining in the top of the can as the tear off strip is removed, with upward motion of the straw being aided by a float member mounted on the straw. U.S. Pat. No. 3,946,895 describes a can having a top including tear-out strip that is pulled into a upstanding position by a ring attached to the top of the tear-out strip, while a plastic apron including a hole holding the top portion of a straw bent into an L-shape is attached to the bottom of the tear-out strip. When the tear-out strip is opened, the top end of the straw is rotated upward with it, straightening the straw. U.S. Pat. No. 4,226,356 describes a can having a tear-out strip that includes ridges holding a bent over upper portion of a straw held within the can, so that removing the tear-out strip straightens the upper portion, pulling it outward through an opening in the top of the can. U.S. Pat. No. 4,228,913 describes a beverage can holding a straw having a lower portion formed as a resilient bellows. Both this lower portion and an upper portion are held in cylindrical guides attached to the side of the can, with the upper end being held under a tab that is pulled upward to expose an opening in the top of the can and to allow the top of the straw to move upward as the bellows elongates. U.S. Pat. No. 4,356,927 describes a can in which a straw is held by upper and lower guides fastened within the can to its side or by depressions in the removable tab and in the can bottom, and in which the lower end of the straw is bent at a right angle, with resilient corrugations in the straw forming the bend, so that, when the tab in the top is opened upward, the straightening of the bend in the straw pushes its upper end upward.

However, changes in the design of cans for holding beverages under pressure that can be opened without an opening tool have resulted in the general use of bend down tabs instead to tear off tabs that are pulled upward. Since bend-down tabs are not readily removed from the can, the tabs themselves do not become sources of liter, and additionally since they are not detached, they cannot be dropped into the can, from which they may be accidentally swallowed. Therefore, more recent patents show cans internally holding straws that a actuated for use by bending down a tab to open the can. For example, U.S. Pat. No. 4,923,083 describes a beverage can having a non-detachable bend down tab and a straw including corrugated portions that are deflected to provide a pop-up characteristic, with the upper end of the straw being held by a rotatable straw delivery mechanism. This mechanism holds the straw out of the way of the tab during its initial downward pivoting movement, and then moves the straw into position under the opening when the final downward pivoting movement of the tab brings the tab into contact with an elbow, portion of the straw delivery mechanism. U.S. Pat. No. 5,244,112 describes a can including a tab that is pivoted downward by an actuator riveted to the tab, a straw held within the can, a support structure holding the straw substantially parallel to the longitudinal axis of the body of the can and rotating the straw into alignment with the opening in the top of the can, and a float moving the straw upward. U.S. Pat. No. 6,354,460 describes a can holding a straw engaging a floating member that is located adjacent to the lid when the container is filled with a fluid. The floating member includes a contoured or cam surface which is engaged by the tab in the top of the can as this tab is pivoted downward to open the can, so that the floating member is rotated to bring the straw into position under the opening in the can top. U.S. Pat. No. 6,491,184 describes a can with a downward-opening tab and a straw supporting element movable between a free position in which the first end of the straw is located in the orifice of the device for opening the container and a locked position in which the first end of the straw is arranged in the interior of the can, with the straw supporting element including an intermediate piece having a peripheral edge portion arranged between an upper wall and a peripheral wall of the container by crimping.

SUMMARY OF THE INVENTION

In accordance with a first version of the invention a beverage container is provided, including a container body, an opening tab, a straw, and a straw supporting structure. The container body includes a top and encloses an interior space holding a beverage. The opening tab is formed within the top of the container body to be pivoted downward into the interior space for exposing an opening in the top of the container body. The straw is held within the interior space of the container body. The straw supporting structure, which is fastened to the container body, is disposed within the interior space of the container body. The straw supporting structure includes a straw holding surface holding an upper end of the straw adjacent the top of the container body. As the opening tab is pivoted downward to expose the opening in the top of the container body, the straw holding surface is moved downward by contact between the opening tab and the straw supporting structure.

The straw holding structure may additionally hold the upper end of the straw disposed between the opening tab in the top of the container body and an adjacent edge of the top of the container body, with the upper end of the straw being moved inward to be disposed under the opening in the top of the container body as the straw holding surface is moved downward. The straw holding surface may additionally move the upper end of the straw downward, or the straw holding surface may slide downward on the upper end of the straw, with the upper end of the straw moving inward after the opening tab has moved downward far enough to clear the top of the straw.

The straw supporting structure may include an attachment portion, a cantilever spring portion, and the straw holding surface, with the attachment portion being attached to the body of the container, with the cantilever spring portion extending from the attachment portion, and with the straw holding surface being disposed at an end of the cantilever spring portion. The attachment portion may be attached to the top of the container body by at least one rivet extending downward from the top of the container body. Alternately, the attachment portion may include a lip extending between adjacent surfaces of a lower portion of the container body and the top portion of the container body, which is attached to the lower portion to extend across an open top surface of the lower portion. The cantilever spring portion may then be deflected downward by an edge of the opening tab as the opening tab is pivoted downward to expose the opening in the top of the container body.

The straw is preferably held within the interior space of the can body in a deflected condition, causing the generation of stresses pushing the upper end of the straw upward, through the opening in the top of the container after the opening tab is pivoted downward into the interior space. The straw may be formed as a tube having a uniform shape extending along its length, with the straw being deflected into a bent condition to be held within the interior space. Alternately, the straw may include a flexible portion having a plurality of corrugated pleats, with the flexible portion being deflected into a bent condition or into a compressed condition as the straw is held within the interior space.

DETAILED DESCRIPTION OF THE INVENTION

Figure 1:
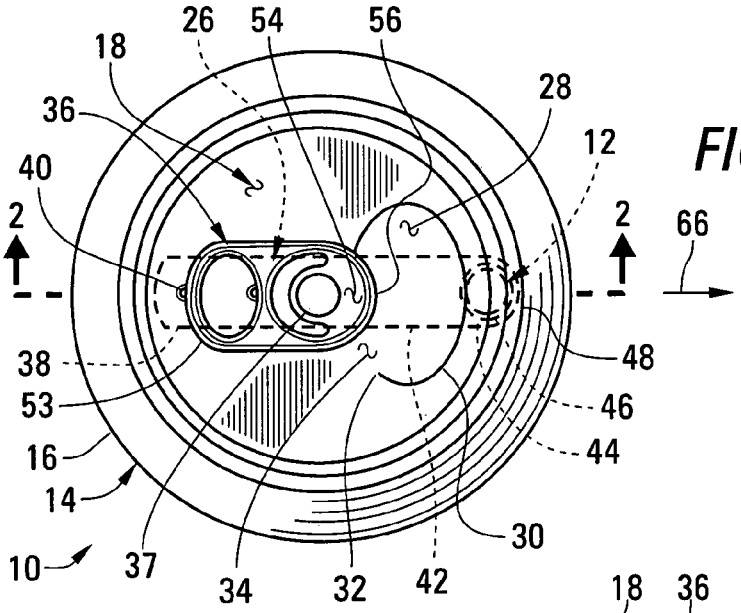
FIG. 1 is a plan view of a beverage container built in accordance with a first embodiment of the invention to include a self deploying straw.
Figure 2:
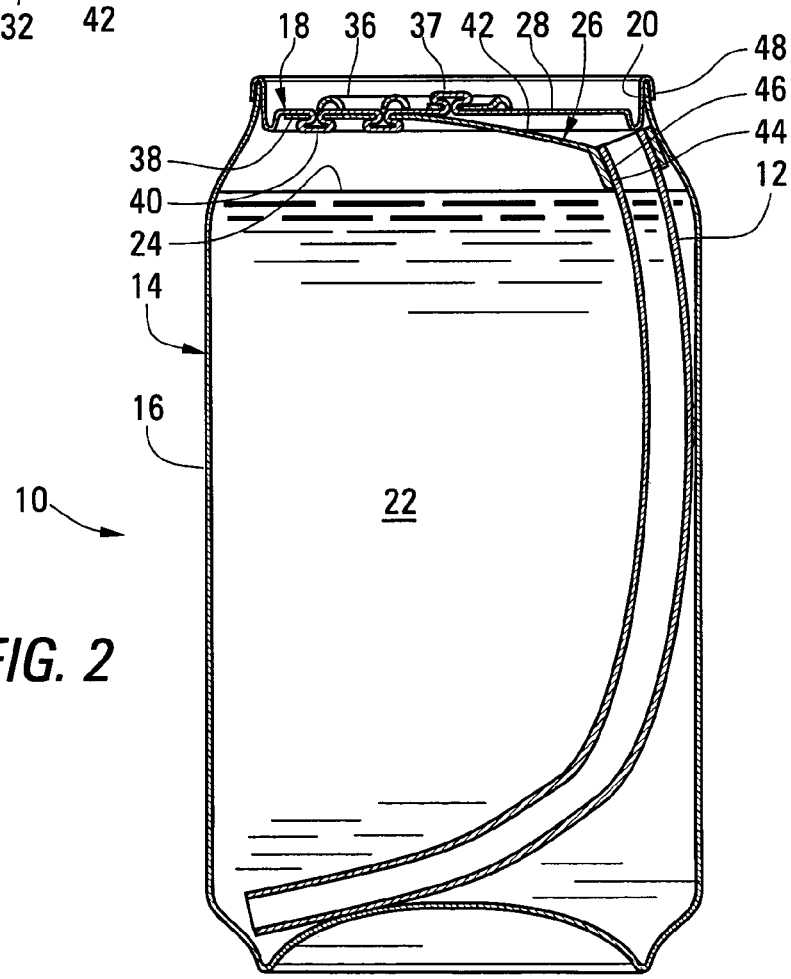
FIG. 2 is a longitudinal cross-sectional elevation of the beverage container of FIG. 1, taken as indicated by section lines 2-2 therein.

FIGS. 1 and 2 show a beverage container 10, in a closed condition, built in accordance with a first embodiment of the invention to include a self deploying straw 12, with FIG. 1 being a plan view thereof, and with FIG. 2 being a longitudinal cross-sectional elevation of the beverage container 10, taken as indicated by section lines 2-2 in FIG. 1. The straw 12 is, for example, formed as a tube having a uniform shape extending along its length. The beverage container 10 includes an elongated container body 14 having a lower portion 16 of the container body 14 and a top 18 of the container body 14 fastened to the lower portion 16 to extend across an open top 20 of the lower portion 16. The top 18 of the container body 14 and the lower portion 16 together enclose an interior space 22, which holds a beverage 24, the straw 12, and a straw supporting structure 26. An opening tab 28 is formed within the top 18 of the container body 14 by a score line 30, forming edges along which the opening tab 28 can be separated from the remaining portion of the top 18 of the container body 14 to provide an opening therein. The score line 30 is interrupted at ends 32, providing an unscored region 34, along which bending occurs as the opening tab 28 is pivoted downward, into the interior space 22. The beverage container 10 additionally includes a lifting tab 36, fastened to the top 18 of the container body 14 by means of a rivet 37 that is formed within the material of the top 18. The straw supporting structure 26 includes an attachment portion 38, which is attached to the top 18 of the container body 14 by means of a pair of rivets 40, extending downward, being formed within the material of the top 18 of the container body 14. The straw supporting structure 26 also includes a cantilever spring portion 42 extending from the attachment portion 38, and a straw holding surface 44 at an end of the cantilever spring portion 42. Preferably, the straw holding surface 44 holds an upper end 46 of the straw 12 in a position disposed between the opening tab 28 of the top 18 of the container body 14 and an adjacent edge 48 of the top 18, with the straw 12 additionally being held against an internal surface 50 of the lower portion 16 of the container body 14.

Figure 3:
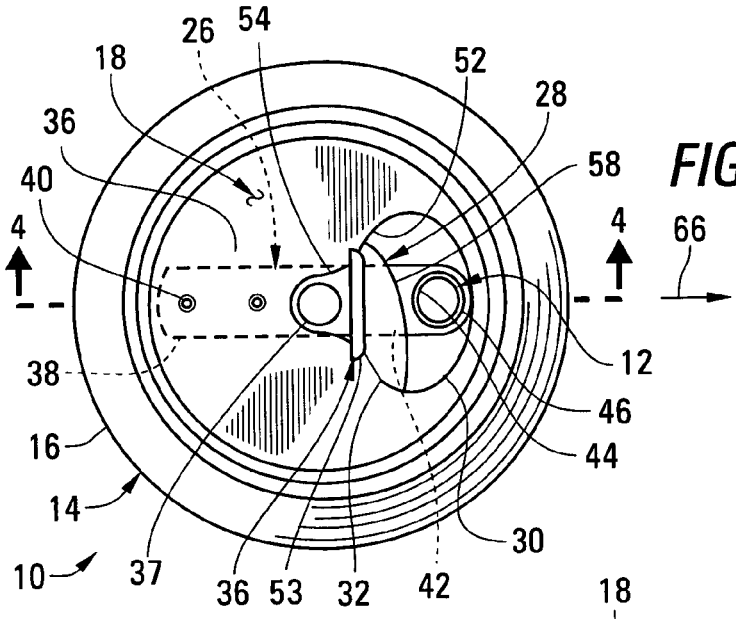
FIG. 3 is a plan view of the beverage container of FIG. 1, shown in an opened condition with the straw deployed therein.
Figure 4:
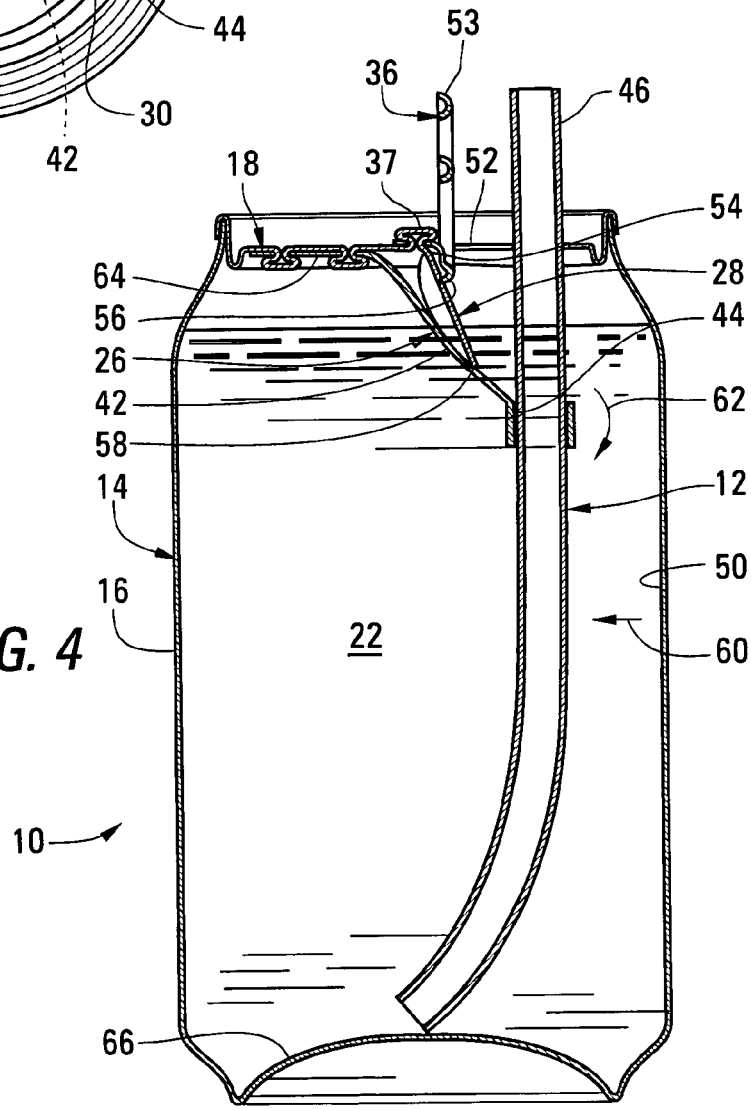
FIG. 4 is a longitudinal cross-sectional elevation of the opened beverage container of FIG. 3, taken as indicated by section lines 4-4 therein.

FIGS. 3 and 4 show the beverage container 10 in an opened condition, with the opening tab 28 pivoted downward to provide an opening 52 within the top 18 of the container body 14, and with the straw 12 being deployed to extend upward through the opening 52. FIG. 3 is a plan view of the opened beverage container 10, while FIG. 4 is a longitudinal cross-sectional view thereof, taken as indicated by section lines 4-4 in FIG. 3. For example, this downward pivoting movement of the opening tab is caused by manually pivoting the lifting end 53 of the lifting tab 36 upward, deflecting a flexible portion 54 of the lifting tab 36, through which the lifting tab 36 is attached to the top 18 of the container body 14 with the rivet 37, with a lever arm 56 at an end of the opening ring 36 pushing the opening tab 28 downward.

As the opening tab 28 is pivoted downward, its edge 58 deflects the cantilever spring portion 42 of the straw supporting structure 26 downward, so that the straw holding surface 44 moves the upper end 46 of the straw 12 inward, in the direction of arrow 60, away from the internal surface 50 of the lower portion 16 of the container body 14, so that the upper end 46 of the straw is disposed below the opening 52. Preferably, the straw holding surface 44, which extends as an aperture around the straw 12, is rotated in the direction of arrow 62 with the downward deflection of the cantilever spring portion 42 through an angle causing the straw holding surface 44 to extend vertically, perpendicular to the inner surface 64 of the top 18 of the container body 14. Moving the upper end 46 of the straw into alignment with the opening 52 frees the end 46 to move upward through the opening 52, while moving the straw 12 away from the internal surface 50 removes friction or drag forces that would otherwise retard the upward movement of the straw 12. Rotating the straw holding surface 44 to extend vertically additionally removes such drag forces. With such drag forces removed, stresses formed within the straw 12 by its deflection in bending against a lower internal surface 66 of the lower portion 16 of the container body 14 cause the straw 12 to be deployed upward, with its upper end 46 moving through the opening 52, so that this end 52 can be reached by the user and further positioned according to his desires.

The upper end 46 of the straw 12 may move downward with the straw holding surface 44, or this surface 44 may slide on the upper end 46 of the straw 12, with the straw being pulled inward, away from the adjacent edge 48 of the container top 18, by the deflection of the cantilever spring portion 42, into a position under the opening 52 after passage to the edge 58 of the opening tab 28 by the upper end 46 of the straw 12.

Since the ends 32 of the score line 30 are asymmetrically disposed relative to the opening 52, the opening tab 28 is pivoted downward at an oblique angle relative to the direction in which the cantilever portion 42 of the straw supporting structure 26 extends, as indicated by arrow 66. Despite the resulting movement of the edge 58 of the opening tab 28 along the cantilever portion 42 at an oblique angle, the cantilever portion 42 is preferably configured to resist substantial twisting while providing downward movement of the straw holding surface 44.

Figure 5:
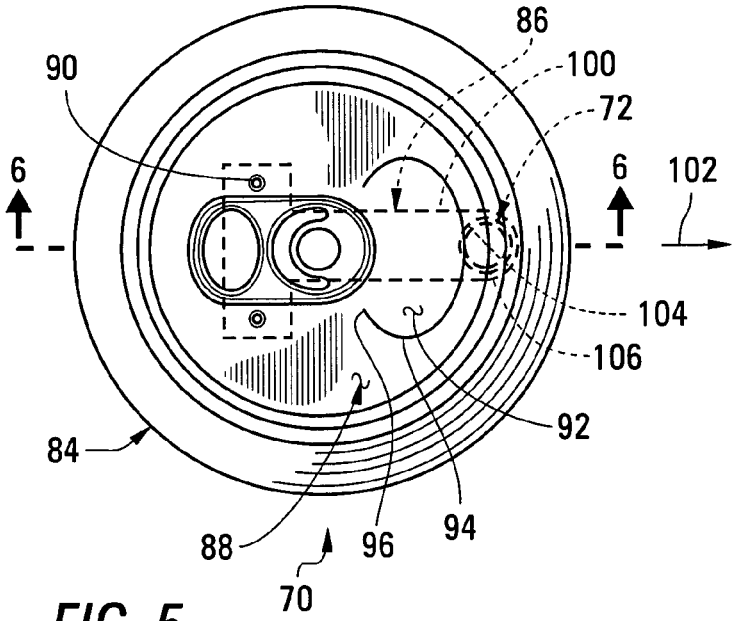
FIG. 5 is a plan view of a beverage container built in accordance with a second, embodiment of the invention to include a self-deploying straw having a bent flexible section.
Figure 6:
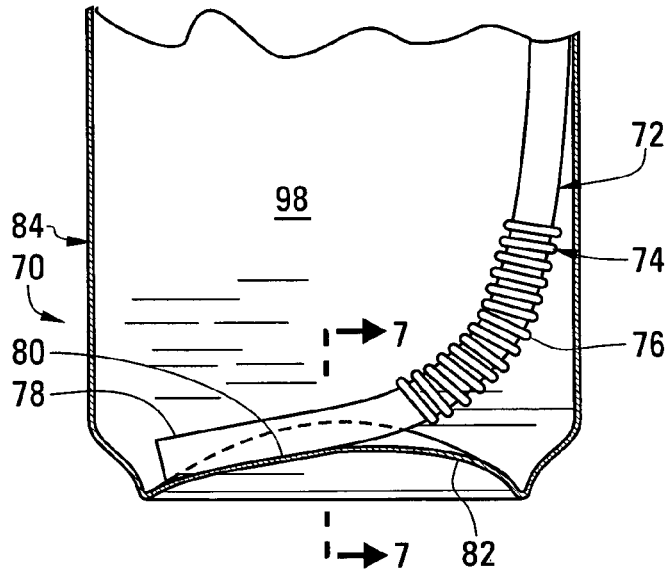
FIG. 6 is a fragmentary longitudinal cross-sectional elevation of the berate container of FIG. 5; taken as indicated by section lines 6-6 therein.
Figure 7:
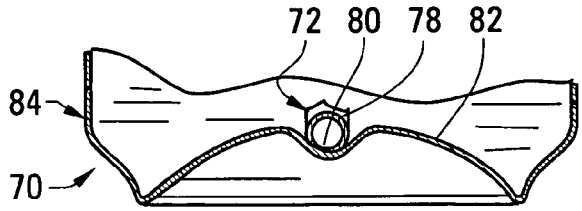
FIG. 7 is a fragmentary longitudinal cross-sectional elevation of the beverage container of FIG. 5, taken as indicated by section lines 7-7 in FIG. 6.

FIGS. 5-7 show a beverage container 70, in a closed condition, built in accordance with a second embodiment of the to include a self-deploying straw 72 having a flexible section 74 with corrugated pleats 76 that are deflected by bending when the straw 72 is placed within the container 70. FIG. 5 is a plan view of the beverage container 70, while FIGS. 6 and 7 are fragmentary longitudinal cross-sectional elevations thereof, with FIG. 6 being taken as indicated by section lines 6-6 in FIG. 5, and with FIG. 7 being taken as indicated by section lines 7-7 in FIG. 6. A lower end 78 of the straw 72 is held within a depression 80 formed within the bottom 82 of the body 84 of the container 70.

The beverage container 70 includes a straw supporting structure 86 that is similar to the straw supporting structure 26 described above in reference to FIGS. 1-4, except that the straw supporting structure 86 is attached to the top 88 of the container body 84 by a different pattern of rivets 90. Also, as shown in the example of FIG. 5, an opening tab 92 within the top 88 of the container body 84 is formed by a score line 94 having ends 96 symmetrically arranged relative to the opening tab 92, so that this tab 92 is bent downward, into the space 98 within the container body 84 at an angle perpendicular to the direction in which a cantilever spring portion 100 of the straw supporting structure 86 extends, as indicated by arrow 102. When the tab 92 is opened, the resulting deflection of the cantilever spring portion 100 brings a straw holding surface 104 of the straw supporting structure 86 downward and inward, opposite the direction of arrow 102, so that the upper end 106 of the straw 72 is brought into position under an opening within the top 88 provided by the opening of the tab 92. Stresses stored primarily within the flexible portion 74 of the straw 72 during its installation within the beverage container 70 then cause the upper end 106 of the straw 72 to move upward through the opening thus provided within the top 88.

Figure 8:
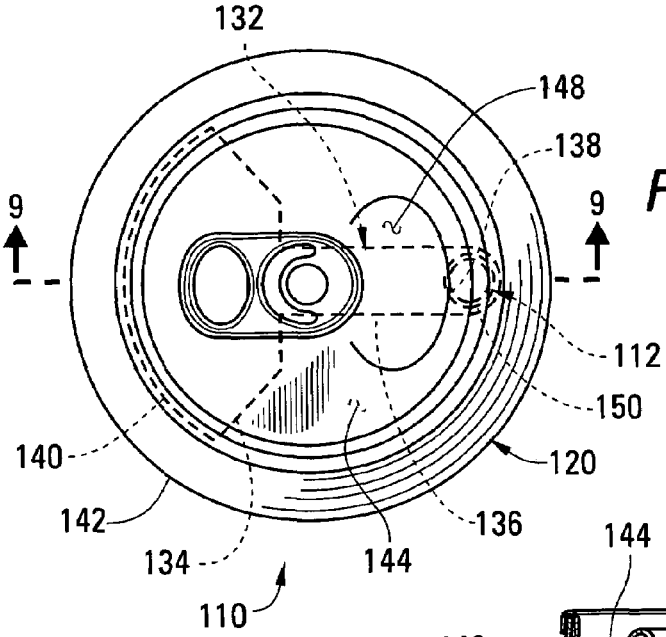
FIG. 8 is a plan view of a beverage container built in accordance with a third embodiment of the invention to include a self-deploying straw having a compressed flexible section.
Figure 9:
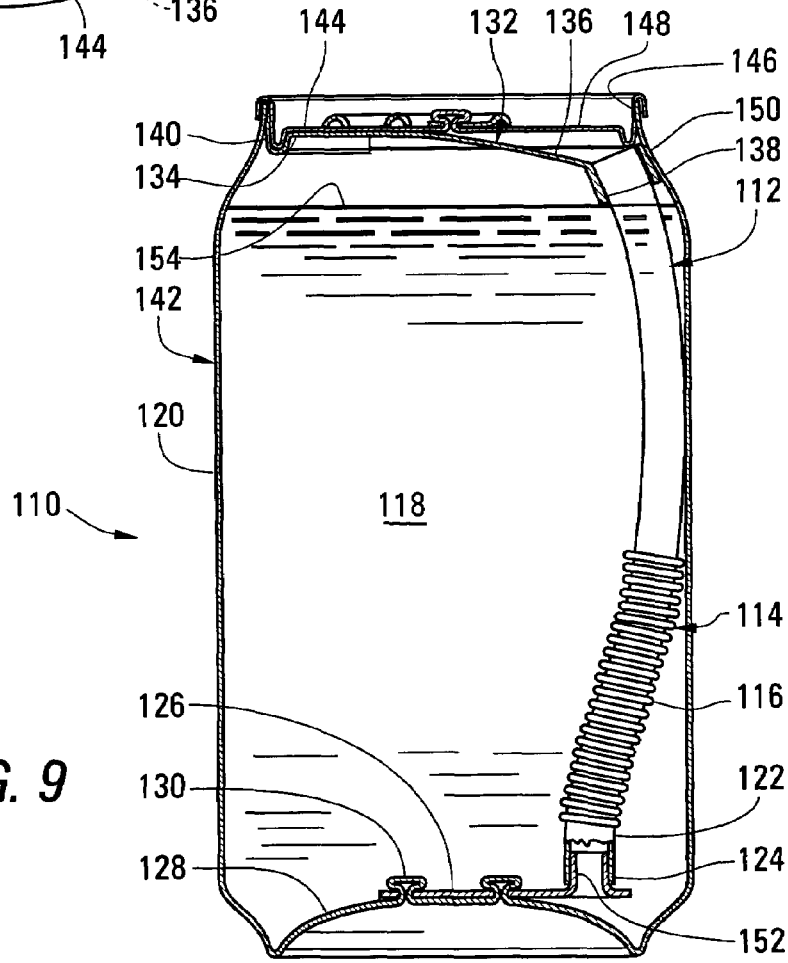
FIG. 9 is a longitudinal cross-sectional elevation of the beverage container of FIG. 8; taken as indicated by section lines 9-9 therein.

FIGS. 8 and 9 show a beverage container 110, in a closed condition, built in accordance with a third embodiment of the invention to include a self-deploying straw 112 including a flexible section 114 with corrugated pleats 116, with the flexible section 114 being compressed when the straw 112 is placed within the container 110. FIG. 8 is a plan view of the beverage container 110, while FIG. 9 is a longitudinal cross-sectional view thereof, taken as indicated by section lines 9-9 in FIG. 8. The straw 112 is placed within an inner space 118 of a body 120 of the beverage container 110 with its lower end 122 being installed on a cylindrical straw receiving surface 124 of a straw receiving member 126 that is attached to the bottom 128 of the container body 120 by means of a pair of upward extending rivets 130.

The beverage container 110 additionally includes a straw supporting structure 132 having an attachment portion 134, a cantilever spring portion 136, and a straw holding surface 138. The attachment portion 134 includes a lip 140 extending between a lower portion 142 of the container body 120 and a top 144 of the container body 120, which is attached to the lower portion 142 to extend across an open top 146 of the lower portion 142. To open the beverage container 110, a tab 148 in the top 144 is pushed downward into the space 118 within the body 120, causing a downward deflection of the cantilever spring portion 136 to bring the straw holding surface 138 of the straw supporting structure 86 downward and inward, so that an upper end 150 of the straw 112 is brought into position under an opening within the top 144 provided by the opening of the tab 148. Stresses stored primarily within the flexible portion 114 of the straw 112 during its installation within the beverage container 70 then cause the upper end 150 of the straw 112 to move upward through the opening thus provided within the top 144, with the lower end 122 of the straw 112 remaining on the straw receiving surface 124, and with a hole 152 within the straw receiving surface 124 providing a passage for movement of a beverage 154 within the container 110 into the straw 112.

The straw 12, 72, 112 is composed, for example, of a thermoplastic resin, such as polyurethane or a polyester material. The straw supporting structure 26, 86, 132 may be composed of a thermoplastic resin, such as polycarbonate, or of a metal, such as aluminum. While the invention is shown as being included in an aluminum can, it is understood that the invention can readily be used in containers made from other materials, such as steel and coated cardboard materials.

While the invention has been described in several forms or embodiments with some degree of particularity, it is understood that this description has been given only by way of example, with various features of the invention being combined in the particular embodiments for purposes of illustration. For example, the attachment structure 134 described in reference to FIGS. 8 and 9 is understood to be readily used with the straw 12, described in reference to FIGS. 1-4. It is further understood that many variations can be made without departing from the spirit and scope of the invention, as defined in the appended claims.

What is claimed is:

1. A beverage container comprising:

a container body including a top and enclosing an interior space holding a beverage;

an opening tab formed within in the top of the container body to be pivoted downward into the interior space for exposing an opening in the top of the container body;

a straw held within the interior space of the container body; and a straw supporting structure, separate from the opening tab, fastened to the container body rigidly and not rotatably at a location spaced away from the opening tab, and disposed extending under the opening tab within the interior space of the container body, including a straw holding surface holding an upper end of the straw adjacent the top of the container body, wherein, as the opening tab is pivoted downward to expose the opening in the top of the container body, the straw holding surface is moved downward by sliding contact between the opening tab and the straw supporting structure to move the upper end of the straw downward.

2. The beverage container of claim 1, wherein the straw holding surface holds the upper end of the straw disposed between the opening tab in the top of the container body and an adjacent edge of the top of the container body, and as the straw holding surface is moved downward, the upper end of the straw is moved inward to be disposed under the opening in the top of the container body.

3. The beverage container of claim 1, wherein, as the straw holding surface is moved downward, the upper end of the straw is moved downward.

4. The beverage container of claim 1, wherein the straw supporting structure includes:

an attachment portion rigidly and not rotatable attached to the body of the container;

a cantilever spring portion extending from the attachment portion; and the straw holding surface disposed at an end of the cantilever spring portion.

5. The beverage container of claim 4, wherein the cantilever spring portion is deflected downward by movement of an edge of the opening tab along the cantilever spring portion as the opening tab is pivoted downward to expose the opening in the top of the container body.

6. The beverage container of claim 4, wherein the straw holding surface comprises an aperture extending around the straw, and the straw holding surface is rotated with downward deflection of the surface of the cantilever spring portion into an orientation in which surfaces of the aperture extend perpendicular to an inner surface of the top of the container body, wherein drag forces between the surfaces of the aperture and an upper end of the straw before the straw holding surface is rotated into the orientation in which surfaces of the aperture extend perpendicular to the inner surface of the top of the container cause the straw to move downward with the straw holding surface, and wherein rotation of the straw holding surface into the orientation in which surfaces of the aperture extend perpendicular to the inner surface of the top frees the upper end of the straw to move upward through the opening in the top of the container.

7. The beverage container of claim 4, wherein the straw is held in contact with an internal surface of the body of the container before downward deflection of the cantilever spring portion of the straw supporting structure, and downward deflection of the cantilever spring portion of the straw supporting structure moves the straw away from the internal surface of the body of the container.

8. The beverage container of claim 4, wherein the attachment portion of the straw supporting structure is attached to the top of the container body by at least one rivet, formed from material within the top of the container body, extending downward from the top of the container body.

9. The beverage container of claim 4, wherein the container body includes a lower portion having an open top surface and the top of the container body, attached to the lower portion to extend across the open top surface of the lower portion, the attachment portion of the straw supporting structure includes a lip fastened between adjacent surfaces of the lower portion of the container body and the top of the container body.

10. The beverage container of claim 1, wherein the straw is held within the interior space in a deflected condition causing the generation of stresses pushing the upper end of the straw upward, through the opening in the top of the container after the opening tab is pivoted downward into the interior space.

11. The beverage container of claim 10, wherein the straw is formed as a tube having a uniform shape extending along its entire length, the straw is deflected into a bent condition to be held within the interior space.

12. The beverage container of claim 10, wherein the straw includes a flexible portion having a plurality of corrugated pleats, and the flexible portion of the straw is deflected into a bent condition as the straw is held within the interior space.

13. The beverage container of claim 10, wherein the straw includes a flexible portion having a plurality of corrugated pleats, and the flexible portion of the straw is deflected into a compressed condition as the straw is held within the interior space.

14. The beverage container of claim 10, wherein a lower portion of the container body includes a straw receiving surface holding a lower end of the straw as the straw is held within the interior space.

15. The beverage container of claim 1, additionally comprising a lifting tab, including a lifting end and a lever end, attached to pivot between the lifting end and the lever end, wherein moving the lifting end upward moves the lever end downward, causing the opening tab to be pivoted downward into the interior space for exposing an opening in the top of the container body.

16. A beverage container comprising:

a container body including a top and enclosing an interior space holding a beverage;

an opening tab formed within in the top of the container body to be pivoted downward into the interior space for exposing an opening in the top of the container body;

a straw held within the interior space of the container body in a deflected condition; and a straw supporting structure including an attachment portion rigidly fastened to the top of the container body at a location spaced away from the opening tab, a cantilever spring portion extending in a first direction from the attachment portion, and a straw holding portion holding an upper end of the straw at an end of the cantilever spring portion opposite the attachment portion, wherein pivoting the opening tab downward causes movement of an edge of the opening tab along the cantilever spring portion to deflect the cantilever spring portion downward, and wherein downward deflection of the cantilever spring portion causes inward movement of the straw holding portion and the upper end of the straw, opposite the first direction, and wherein stresses induced in the straw by deflection cause the upper end of the straw to move upward, through the opening in the top of the container body after the downward deflection of the cantilever spring portion.

17. The beverage container of claim 16, wherein the straw holding portion moves the upper end of the straw downward.

18. The beverage container of claim 16, wherein the straw holding portion slides downward on the upper end of the straw as the straw holding portion moves downward and inward.

19. The beverage container of claim 16, additionally comprising a lifting tab, including a lifting end and a lever end, attached the top of the container body to pivot between the lifting end and the lever end, wherein moving the lifting end upward moves the lever end downward, causing the opening tab to be pivoted downward into the interior space for exposing an opening in the top of the container body.

* * * * *